US006694767B2

(12) United States Patent
Junca et al.

(10) Patent No.: US 6,694,767 B2
(45) Date of Patent: Feb. 24, 2004

(54) WORK ENCLOSURE HAVING ARTICLE SUPPORTS THAT OBSTRUCT ACCESS OPENINGS

(75) Inventors: Serge Junca, Maspie Lalonquere (FR); Bertrand Michea, Theix (FR)

(73) Assignee: Jouan, Saint-Herblain (FR)

( * ) Notice: Subject to any disclaimer, the term of this patent is extended or adjusted under 35 U.S.C. 154(b) by 0 days.

(21) Appl. No.: 10/173,783

(22) Filed: Jun. 19, 2002

(65) Prior Publication Data

US 2003/0233842 A1 Dec. 25, 2003

(51) Int. Cl.[7] ..... F25D 23/02; F25D 25/02
(52) U.S. Cl. ..... 62/266; 62/382
(58) Field of Search ..... 62/266, 382, 265, 62/378, 336, 337

(56) References Cited

U.S. PATENT DOCUMENTS 2,077,739 A 4/1937 Bryant
2,165,513 A 7/1939 Smith
2,490,694 A 12/1949 Leutheuser
2,552,832 A 5/1951 Ahlstrand et al.
4,624,395 A * 11/1986 Baron et al. ..... 222/129.1
4,768,354 A * 9/1988 Barnwell ..... 62/457.4

* cited by examiner

*Primary Examiner*—Chen Wen Jiang
(74) *Attorney, Agent, or Firm*—Young & Thompson

(57) ABSTRACT

A work enclosure, and in particular a system for low temperature storage that includes a chest provided with a refrigerator unit. The chest has a top plate provided with a plurality of openings each suitable for allowing a support for at least one container of an article for storage to be passed therethrough, the support presenting a working storage height no greater than the height of the chest, and the top of the support is provided with an element of shape matching the shape of the opening so as to close it once the support has been fully inserted through the opening. In some embodiments, automation elements are provided above the top plate of the chest for moving the supports at least in vertical translation so as to enable supports to be inserted and withdrawn via the openings of the chest.

20 Claims, 3 Drawing Sheets

WORK ENCLOSURE HAVING ARTICLE SUPPORTS THAT OBSTRUCT ACCESS OPENINGS

The invention relates to work enclosures, in particular to low temperature storage systems, and more particularly to very low temperature storage systems.

BACKGROUND OF THE INVENTION

In order to conserve samples of blood derivatives, DNA fractions, or other living matter under good conditions, it is necessary for storage to take place at very low temperature, for example at about −80° C. or −85° C.

It is known to perform that type of storage using conventional freezers or even, when necessary, by means of bottles of liquid nitrogen for temperatures that are lower still.

Known freezers are of the same type as home freezers and they generally comprise a vertical door for a cupboard version or a horizontal door for a chest version.

Nevertheless, such freezers present at least two drawbacks for the above-mentioned storage, specifically:

opening the single door causes a large amount of heat to be exchanged between the stored substances and the outside air each time the door is opened, even if the door is opened solely for the purpose of inserting or removing a single article, thus leading to problems of the inside of the chest warming up and to frost forming; and it is very difficult or even impossible to automate the transfer of articles of the kind that are generally placed in containers, specifically because there is only one door. Unfortunately, the quantity of articles stored and the frequency of access to said articles now justify or even require such freezers to be automated.

OBJECTS AND SUMMARY OF THE INVENTION

That is why the invention proposes an original system making it possible amongst other things to solve the above-mentioned drawbacks. Although it is particularly adapted to temperatures in the range −80° C. to −85° C., the present invention also applies to temperatures that are lower and indeed to temperatures that are higher. The invention can also be adapted to other working enclosures such as ovens, $CO_2$ incubators, . . .

The invention thus provides an assembly comprising a work, first chamber and a sealed, second chamber provided with means for treating the air inside the second chamber, the inside of the first chamber defining a work space having means for creating a controlled atmosphere within the work space and at least one support for containers of articles to be placed in the work space, the first enclosure having a top plate with at least one access opening formed therethrough giving access to the work space to enable the support to be inserted therein and withdrawn therefrom, the support being provided with a shutter element of dimensions greater than the dimensions of the access opening so as to close the access opening under the effect of gravity when the support is placed in the work space through the access opening, the second enclosure being placed above the top plate of the first enclosure.

The invention also provides a work enclosure defining an internal work space and containing means for creating a controlled atmosphere inside the work space, and at least one support for article containers to be placed in the work space, the enclosure having a top plate with at least one access opening formed therethrough giving access to the work space to enable the support to be inserted therein and withdrawn therefrom, the support being provided with a shutter element for closing the access opening under the effect of gravity when the support is placed through the access opening into the work space, the enclosure having automatic means above the top plate for moving containers on the supports.

The invention also provides a work enclosure defining an inside work space and comprising means for creating a controlled atmosphere in the work space and at least one support for article containers to be placed in the work space, the enclosure comprising a top face with at least one access opening formed therethrough giving access to the work space to enable the support to be inserted therein and withdrawn therefrom, and shutter means for shutting the access opening, the support being provided with a shutter element for closing the access opening under the effect of gravity when the support is placed in the work space through the access opening, with the top plate being extended into the work space by a bottom skirt surrounding the access opening.

BRIEF DESCRIPTION OF THE DRAWINGS

The invention will be well understood on reading the following description which refers to the accompanying drawings, in which.

MORE DETAILED DESCRIPTION

Figure 1:
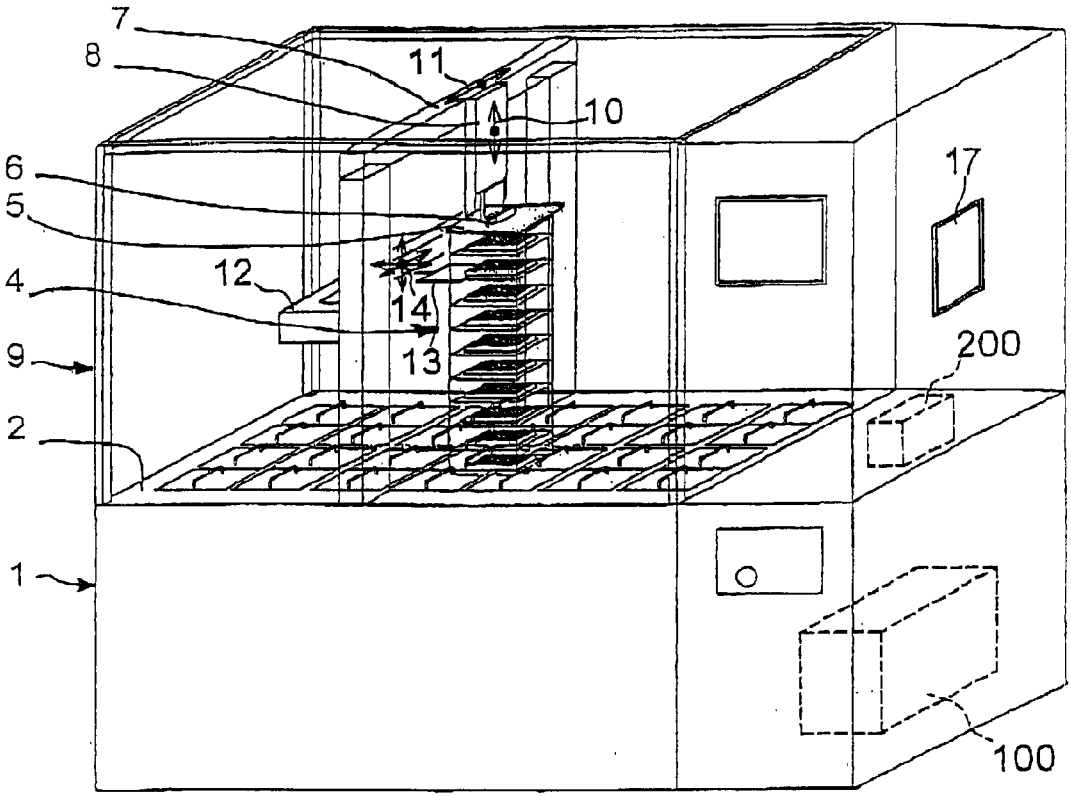
FIG. 1 is a diagrammatic view of a freezer of the invention.

The storage system shown in FIG. 1 comprises an insulating chest 1 provided with a refrigerator unit 100 of a type that depends, naturally, on the volume of the chest, on the way refrigeration is achieved, and on the temperature that is to be reached.

Figure 2:
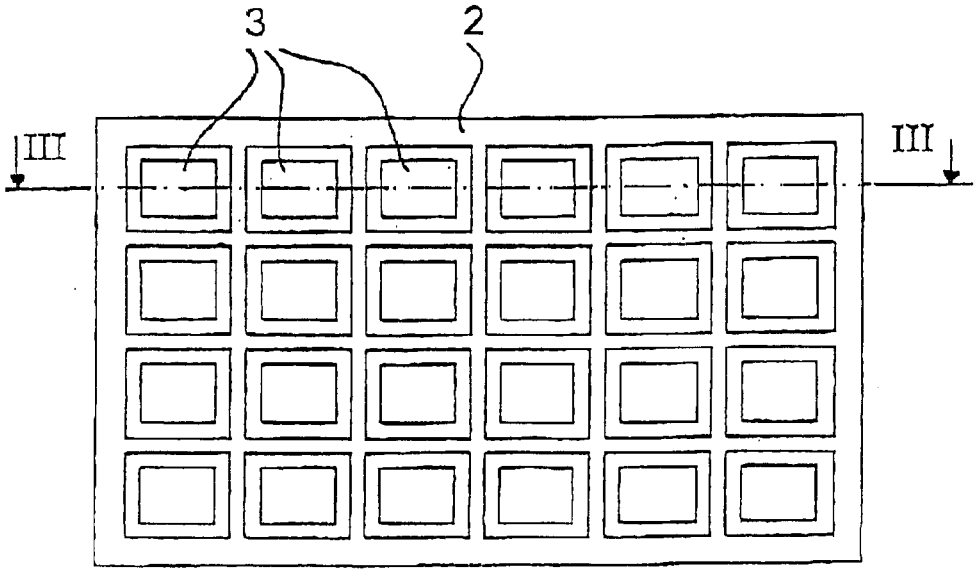
FIG. 2 shows the top plate without its container supports.
Figure 3:
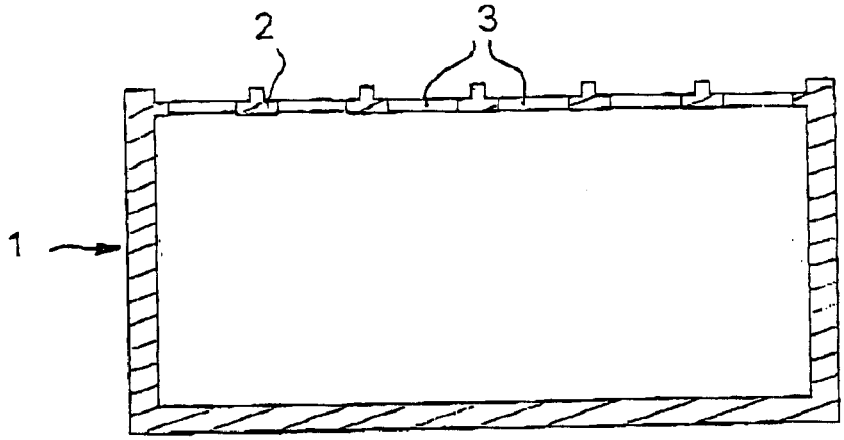
FIG. 3 is a section view on III—III of FIG. 2.

The chest 1 is provided on top with an insulating top plate 2 provided with a plurality of openings 3 that can be seen more particularly in FIGS. 2 and 3.

As shown clearly in the drawings, the openings 3 are rectangular in shape and they are arranged in rows and columns.

Figure 5:
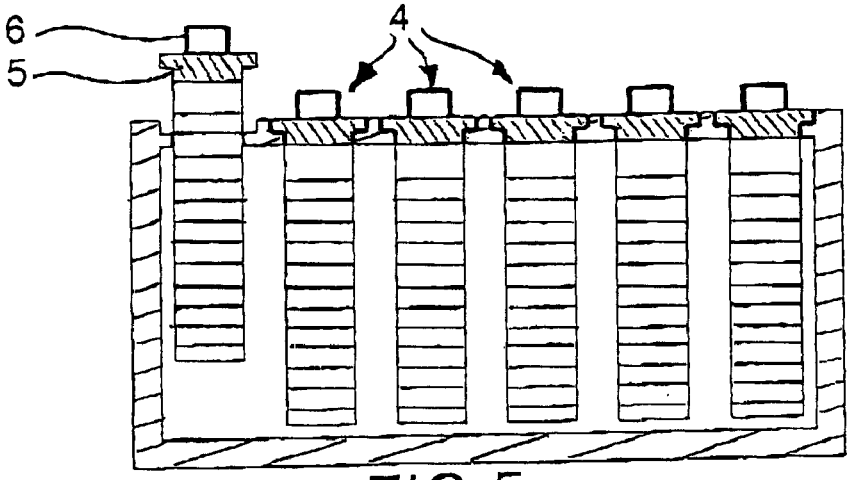
FIG. 5 is a section view on V—V of FIG. 4.

Each opening 3 is designed to receive a support 4, in this case in the form of a rack fitted with a plurality of superposed shelves, as can be seen in FIGS. 1 and 5, each shelf being intended to receive at least one individual container of an article for storage, e.g. in the form of a box, a plate, or a tube.

Figure 4:
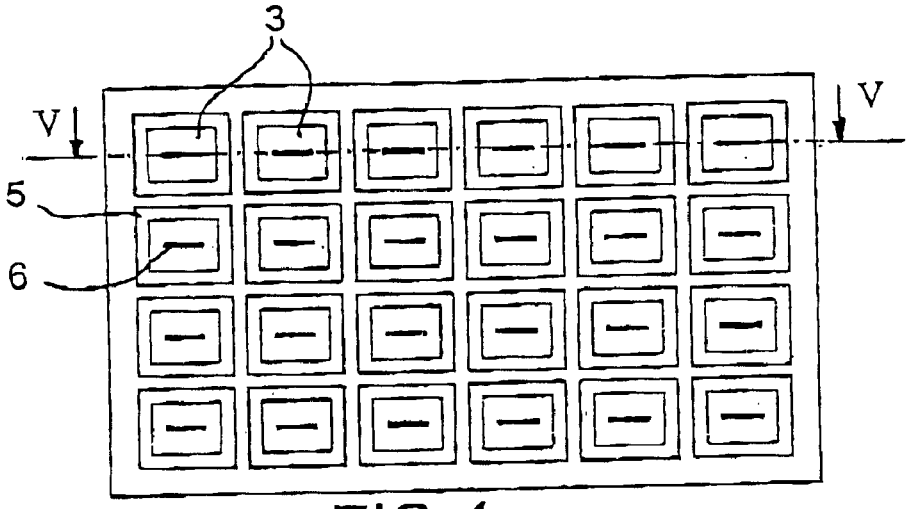
FIG. 4 corresponds to FIG. 2, but with the supports in place.

The top portion of each support 4 is provided with a shutter plate 5 of insulating material (FIGS. 4 and 5) and of dimensions that are slightly greater than the dimensions of the openings 3 so as to close them in substantially leaktight manner under the effect of gravity (FIG. 5).

It will be understood that an opening 3 in the top plate 2 and the corresponding volume of the chest immediately beneath it define a housing for a support 4 which can thus be inserted into said housing and can be withdrawn therefrom.

Each shutter plate 5 is also provided in this case with a handle 6 (FIGS. 1 and 5).

It is clear that each opening 3 is thus closed by the shutter plate 5 of a support 4 whether or not the support contains any containers, with thermal insulation being achieved under the effect of gravity by the shutter plate 5 being of appropriate dimensions.

The handles 6 enable the support 4 to be handled easily so they can thus be extracted from or inserted into the chest 1 by passing through the openings 3.

As a result, all of the openings 3 can be closed by the support 4, even when the supports are totally or partially empty, and it will thus be understood that momentarily raising a support in order to take out or to insert one or more containers leads to an exchange of heat that is much more limited than with a conventional single door freezer.

Furthermore, such a vertical configuration makes automation easy, as shown diagrammatically in FIG 1.

By way of example, FIG. 1 shows a gantry 7 mounted to move over the top plate 2 and also provided with support gripping means 8. The gantry 7 is placed in a sealed enclosure 9 that surmounts the chest 1, said enclosure comprising air treatment means 200 such as dehumidifier means, for example, so as to avoid frosting as much as possible. The gripping means 8 can move up and down under drive from automatic drive means 10, and they can also move in translation along the gantry under drive from automatic drive means 11 so that each support 4, once it has been identified, can be moved up and down automatically.

In addition, means are provided on the gantry to enable containers placed on the support to be moved in horizontal translation in automatic manner.

By way of example, these means can be carried by a cross-member 12 secured to the gantry 7, a spatula 13, and means 14 for moving the spatula in translation in two orthogonal horizontal directions and in a vertical direction. In FIG. 1, the spatula 13 is engaged under a container.

In order to withdraw the container, the means 14 move the spatula 13 to the right relative to the position shown in FIG. 1 until it is located fully under the container.

Thereafter, the spatula 13 is lifted a little and then withdrawn to the left under drive from the displacement means 14 until it has been fully disengaged from the support 4. The displacement means 10 then lower the support 4 until its shutter plate 5 recloses the corresponding opening 3, after which the gantry 7 is moved to the right in FIG. 1 to the right-hand end of the enclosure. The displacement means 14 then move the spatula 13 to the right so that an operator can withdraw the container through an opening 17 provided in the side wall of the enclosure 9.

In addition, it is clear that the disposition in rows and columns of the openings 3 makes it easy to locate the supports, regardless of whether they are to be moved manually or automatically.

Naturally, numerous other means could be provided for modifying and/or adding to the embodiment described, for example additional means for loading and unloading containers, and/or means for reading bar codes.

In addition to its simplicity, the invention is easily adapted to chests of any size.

More generally, the chest 1 can be an enclosure provided with means for controlling the atmosphere inside it.

These means can be designed to control a physical parameter of the atmosphere, for example its temperature or its pressure, or a chemical parameter, for example its composition, and in particular its $CO_2$ content or its relative humidity.

Thus, the chest 1 can be a thermostatically controlled enclosure such as an oven provided with means for heating its atmosphere, or a $CO_2$ incubator, . . .

Figure 6:
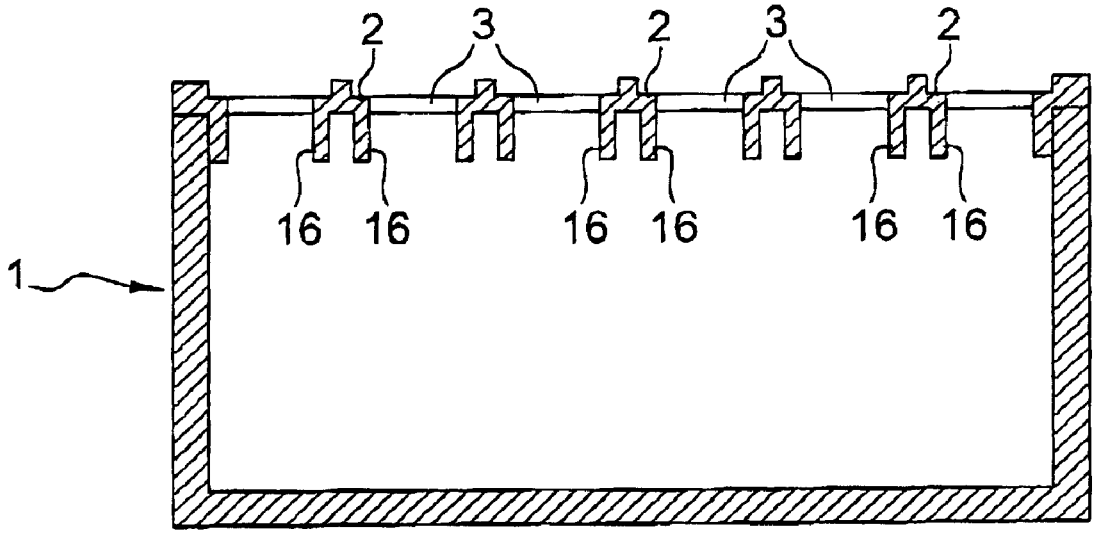
FIG. 6 is a view analogous to FIG. 3, showing a variant of the invention.

FIG. 6 shows a variant in which the top plate 2 is extended downwards by skirts 16 surrounding the openings 3. These skirts 16 may be integrally molded with the top plate 2, for example. The skirts are of a section corresponding to the section of the openings 3, i.e. in the example shown they are rectangular in section. The skirts 16 form wells through which the supports 4 can be passed. Because of the presence of the skirts 16, the ton plate 2 provides improved thermal insulation between the inside and the outside of the chest 1.

It should also be observed that the enclosure 9 can contain means for temporary storage, for unfreezing, or for handling containers.

What is claimed is:

1. An assembly comprising a work, first enclosure and a sealed, second enclosure provided with means for treating the air inside the second enclosure, the first enclosure defining an inside work space and having means for creating a controlled atmosphere within the work space and at least one support for containers of articles to be placed in the work space, the first enclosure having a top plate with at least one access opening formed therethrough giving access to the work space to enable the support to be inserted therein and withdrawn therefrom, the support being provided with a shutter element of dimensions greater than the dimensions of the access opening so as to close the access opening under the effect of gravity when the support is placed in the work space through the access opening, the second enclosure being placed above the top plate of the first enclosure.

2. An assembly according to claim 1, in which a plurality of access openings are formed through the top plate of the first enclosure, and the first enclosure has a plurality of supports for article containers, each being suitable for placing in the work space through one of the access openings, the access openings being arranged in rows and columns.

3. An assembly according to claim 1, in which the support is a rack provided with a plurality of superposed shelves, each being suitable for receiving at least one article container.

4. An assembly according to claim 1, in which the shutter element is provided with handle means.

5. An assembly according to claim 1, comprising automatic means above the top plate of the first enclosure for moving the support at least in vertical translation so as to enable the support to be inserted and withdrawn through the access opening.

6. An assembly according to claim 1, further comprising automatic means for moving containers based on the supports in horizontal translation.

7. A work enclosure defining an internal work space and comprising means for creating a controlled atmosphere inside the work space, and at least one support for article containers to be placed in the work space, the enclosure having a top plate with at least one access opening formed therethrough giving access to the work space to enable the support to be inserted therein and withdrawn therefrom, the support being provided with a shutter element for closing the access opening under the effect of gravity when the support is placed through the access opening into the work space, the enclosure having automatic means above the top plate for moving containers on the supports.

8. An enclosure according to claim 7, in which a plurality of access openings are formed through the top plate, and the enclosure has a plurality of supports for article containers, each being suitable for placing in the work space through one of the access openings, the access openings being arranged in rows and columns.

9. An enclosure according to claim 7, in which the support is a rack provided with a plurality of superposed shelves, each for receiving at least one article container.

10. An enclosure according to claim 7, in which the shutter element is provided with handle means.

11. An enclosure according to claim 7, comprising automatic means above the top plate for moving the support at least in vertical translation, enabling the support to be inserted and withdrawn through the access opening.

12. An enclosure according to claim 7, in which the shutter element is of dimensions larger than the dimensions of the access opening.

13. A work enclosure defining an inside work space and comprising means for creating a controlled atmosphere in the work space and at least one support for article containers to be placed in the work space, the enclosure comprising a top plate with at least one access opening formed therethrough giving access to the work space to enable the support to be inserted therein and withdrawn therefrom, and shutter means for shutting the access opening, the support being provided with a shutter element for closing the access opening under the effect of gravity when the support is placed in the work space through the access opening, with the top plate being extended into the work space by a bottom skirt surrounding the access opening.

14. An enclosure according to claim 13, in which a plurality of access openings are formed through the top plate, and the enclosure has a plurality of supports for article containers, each being suitable for placing in the work space through one of the access openings, the access openings being arranged in rows and columns.

15. An enclosure according to claim 13, in which the support is a rack provided with a plurality of superposed shelves, each for receiving at least one article container.

16. An enclosure according to claim 13, in which the shutter element is provided with handle means.

17. An enclosure according to claim 13, comprising automatic means above the top plate for moving the support at least in vertical translation, enabling the support to be inserted and withdrawn through the access opening.

18. An enclosure according to claim 13, in which the shutter element is of dimensions larger than the dimensions of the access opening.

19. An enclosure according to claim 13, further comprising automatic means for imparting movement in horizontal translation to containers placed on supports.

20. An enclosure according to claim 13, in which the means for creating a controlled atmosphere comprise means for controlling the temperature of the atmosphere in the work space.

* * * * *